US009310072B2

(12) United States Patent
Ainslie

(10) Patent No.: US 9,310,072 B2
(45) Date of Patent: Apr. 12, 2016

(54) NON-SYMMETRIC ARRANGEMENT OF FUEL NOZZLES IN A COMBUSTOR

(75) Inventor: Walter Ernest Ainslie, Ramona, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 904 days.

(21) Appl. No.: 13/542,808

(22) Filed: Jul. 6, 2012

(65) Prior Publication Data

US 2014/0007579 A1 Jan. 9, 2014

(51) Int. Cl.
*F23R 3/28* (2006.01)
*F23C 5/08* (2006.01)

(52) U.S. Cl.
CPC ... *F23C 5/08* (2013.01); *F23R 3/28* (2013.01); *F23R 2900/00013* (2013.01); *F23R 2900/00014* (2013.01)

(58) Field of Classification Search
CPC ..... F23R 3/28; F23R 3/34; F23R 3/36; F23R 3/343; F02C 7/22; F02C 7/222; F02C 7/228
USPC ..... 60/733, 734, 739, 740, 746
See application file for complete search history.

(56) References Cited

U.S. PATENT DOCUMENTS 3,763,650 A 10/1973 Hussey et al.
4,417,439 A 11/1983 Sepulveda et al.
4,548,032 A 10/1985 Sepulveda et al.
4,817,389 A 4/1989 Holladay et al.
5,036,657 A * 8/1991 Seto et al. ..... 60/39.281
5,297,385 A * 3/1994 Dubell ..... F23R 3/10 60/756
5,373,694 A 12/1994 Clark
5,491,970 A 2/1996 Davis, Jr. et al.
5,551,228 A 9/1996 Mick et al.
5,884,483 A 3/1999 Munro
6,898,938 B2 5/2005 Mancini et al.
6,945,053 B2 9/2005 Von Der Bank
6,959,535 B2 11/2005 Mancini et al.
6,968,699 B2 * 11/2005 Howell et al. ..... 60/776
7,836,699 B2 11/2010 Graves
7,950,233 B2 5/2011 Alkabie et al.
8,024,933 B2 9/2011 Woolford et al.
8,024,934 B2 9/2011 Abreu et al.
2009/0107148 A1 4/2009 Pieussergues et al.
2009/0217669 A1 9/2009 Young
2011/0005231 A1 1/2011 Low
2012/0060507 A1 3/2012 King et al.
2012/0125006 A1 5/2012 Saito et al.

OTHER PUBLICATIONS

International Searching Authority, International Search Report and the Written Opinion, Oct. 16, 2013, 13 pages.

* cited by examiner

*Primary Examiner* — Steven Sutherland
(74) *Attorney, Agent, or Firm* — Kinney & Lange, P.A.

(57) ABSTRACT

A fuel nozzle arrangement includes an annular combustor having four quadrants. Fuel injectors are located in the four quadrants and each fuel injector has either a first or second type nozzle attached to it. The first and second type fuel nozzles are located in an array so that at least two of one nozzle type are located together to allow for non-uniform injector spacing with uniform downstream temperatures.

7 Claims, 7 Drawing Sheets

NON-SYMMETRIC ARRANGEMENT OF FUEL NOZZLES IN A COMBUSTOR

BACKGROUND

The present invention relates generally to gas turbine engines and, more particularly, to fuel injectors used in gas turbine engines. Gas turbine engines are rotary-type combustion turbine engines built around a power core made up of a compressor, combustor and turbine, arranged in flow series with an upstream inlet and downstream exhaust. The compressor section compresses air from the inlet, which is mixed with fuel in the combustor and ignited to generate hot combustion gas. The compressor section may include a low, mid, and high pressure compressor sections. The turbine section extracts energy from the expanding combustion gas, and drives the compressor section via a common shaft. The turbine section may include a low, mid, and high pressure compressor sections. Expanded combustion products are exhausted downstream, and energy is delivered in the form of rotational energy in the shaft, reactive thrust from the exhaust, or both.

Gas turbine engines provide efficient, reliable power for a wide range of applications in aviation, transportation and industrial power generation. Small-scale gas turbine engines, such as auxiliary power units, typically utilize a one-spool design, with co-rotating compressor and turbine sections. Larger-scale combustion turbines including jet engines and industrial gas turbines (IGTs) are generally arranged into a number of coaxially nested spools. The spools operate at different pressures, temperatures and spool speeds, and may rotate in different directions.

The combustor includes a plurality of fuel injectors arranged in an annular array about a central axis of the combustor. The fuel injectors atomize and inject fuel into the combustion section of the gas turbine engine. Attached to each fuel injector is a fuel nozzle which controls the exit pattern of the fuel from the injector. Different types of fuel nozzles are used to provide different fuel flows into the combustor, examples of which may include duplex and simplex nozzles. The varying fuel flows provided by different types of nozzles cause some nozzles to burn hotter than others. The difference of combustion temperatures between the hot and cold nozzles causes a non-uniform circumferential temperature gradient throughout the engine.

The fuel injectors are typically arranged in an equally spaced symmetric array within the combustor. However, a symmetric fuel injector assembly can cause significant problems within the combustor due to the non-uniform circumferential temperature gradient. Problems often include burnout of combustor wall surfaces, decrease in combustor stability, fuel puddles, hot starts, compressor stalling, high amplitude combustion noise, limited turndown, premature wear, and high cycle fatigue cracking of structural components in the combustor, see U.S. Pat. Nos. 4,548,032 and 5,551,228; and U.S. Pat. App. No. 2012/0125006 A1. Previous attempts have been made to eliminate these problems by manipulating the pattern of fuel flowing from a symmetrical annular array of fuel nozzles to provide an asymmetrical fuel pattern across the combustor, for example, see previously discussed U.S. Pat. No. 5,551,228.

SUMMARY

A fuel nozzle arrangement includes an annular combustor having four quadrants. A plurality of fuel nozzles is disposed in the four quadrants. Fuel nozzles of a first and second type are disposed onto the fuel injectors so that each fuel injector has either a first or second type nozzle attached to it. The first and second type nozzles are arranged in an array so that at least two of one nozzle type are adjacent to each other.

A gas turbine engine includes a compressor section. The combustor receives air from the compressor section. A turbine section receives combustion gases from the combustor and drives the compressor section. The combustor includes a circumferential array of gas turbine engine fuel nozzles in a non-symmetrical pattern.

A fuel nozzle arrangement includes an annular combustor. A plurality of fuel nozzles is disposed in the combustor. Fuel nozzles of a first and second type are disposed onto the fuel injectors so that each fuel injector has either a first or second type nozzle attached to it. The first and second type nozzles are arranged in a non-alternating pattern of first and second type nozzles.

A fuel nozzle arrangement includes an annular combustor. A plurality of fuel nozzles is disposed in the combustor. Fuel nozzles of a first and second type are disposed onto the fuel injectors so that each fuel injector has either a first or second type nozzle attached to it. The first and second type nozzles are arranged in a non-uniformly spaced circumferential array.

DETAILED DESCRIPTION

Figure 1:
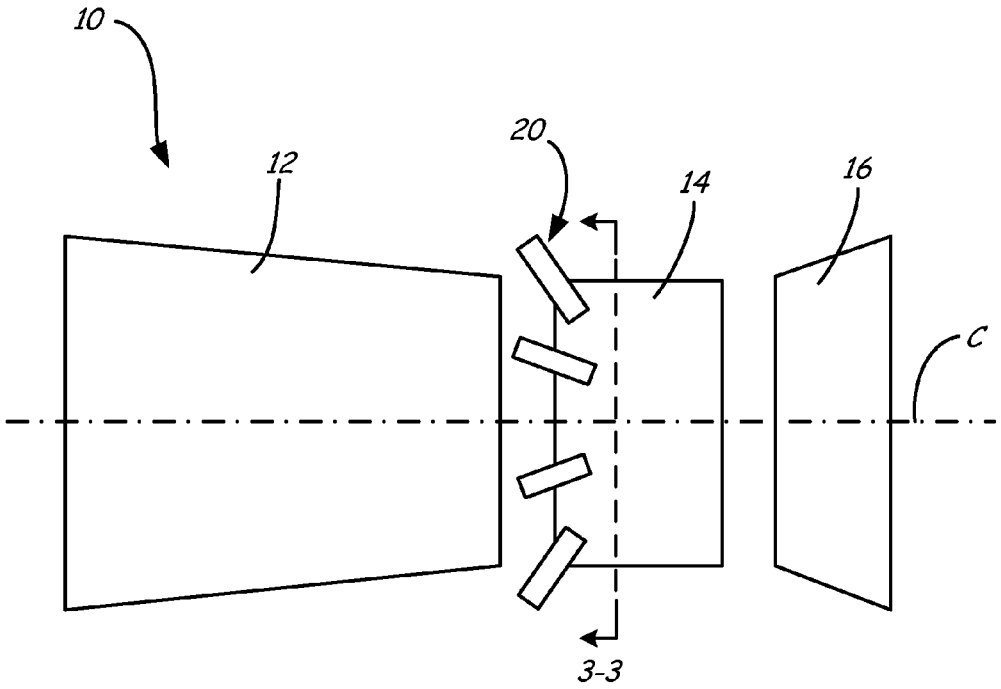
FIG. 1 Prior Art
FIG. 1 is a schematic side view of a prior art gas turbine engine.

FIG. 1 schematically shows conventional gas turbine engine 10 including compressor 12, combustor 14, and turbine 16. Compressor 12 is disposed forward, that is upstream with respect to flow, of combustor 14, and turbine 16 is disposed aft, that is downstream with respect to flow, of combustor 14. Compressor 12, combustor 14, and turbine 16 are generally coaxially disposed about central axis C which constitutes the centerline of gas turbine engine 10. A plurality of fuel injectors 20 is disposed in a circumferential array in combustor 14.

Figure 2:
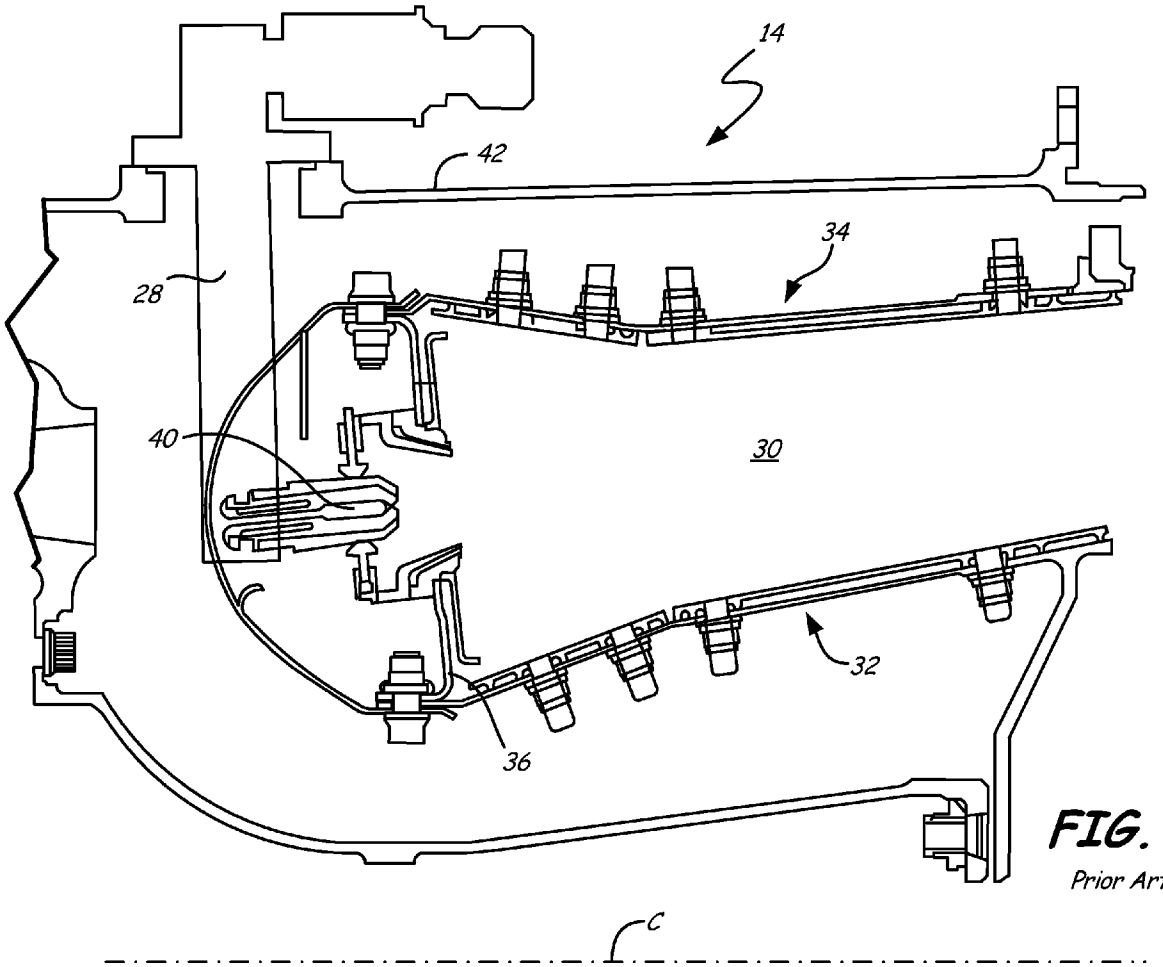
FIG. 2 Prior Art
FIG. 2 is a sectioned side elevation view of a prior art annular combustor.

FIG. 2 illustrates prior art combustor 14, which is disposed concentric with the engine axis C. Combustor 14 includes annular combustion chamber 30 defined by radially inboard liner 32, radially outboard liner 34, and bulkhead 36. Bulkhead 36 extends between the respective upstream ends of inboard liner 32 and outboard liner 34. Collectively, inboard liner 32, outboard liner 34, and bulkhead 36 bound the annular combustion chamber 30 and define a combustor interior volume that extends longitudinally within the annulus formed by the inboard liner 32 and the outboard liner 34 from the bulkhead 36. Bulkhead 36 carries fuel injectors 28 disposed in a circumferential array at spaced intervals about the annular combustion chamber 30. Each fuel nozzle 40 is disposed at the end of a fuel injector 20 (FIG. 1) that extends through outer case 42 of combustor 14 to convey fuel from an external source to the associated fuel nozzle. Each fuel nozzle 40 injects fuel through a spray head into a central stream of air emitted along the centerline of the fuel nozzle.

Figure 3:
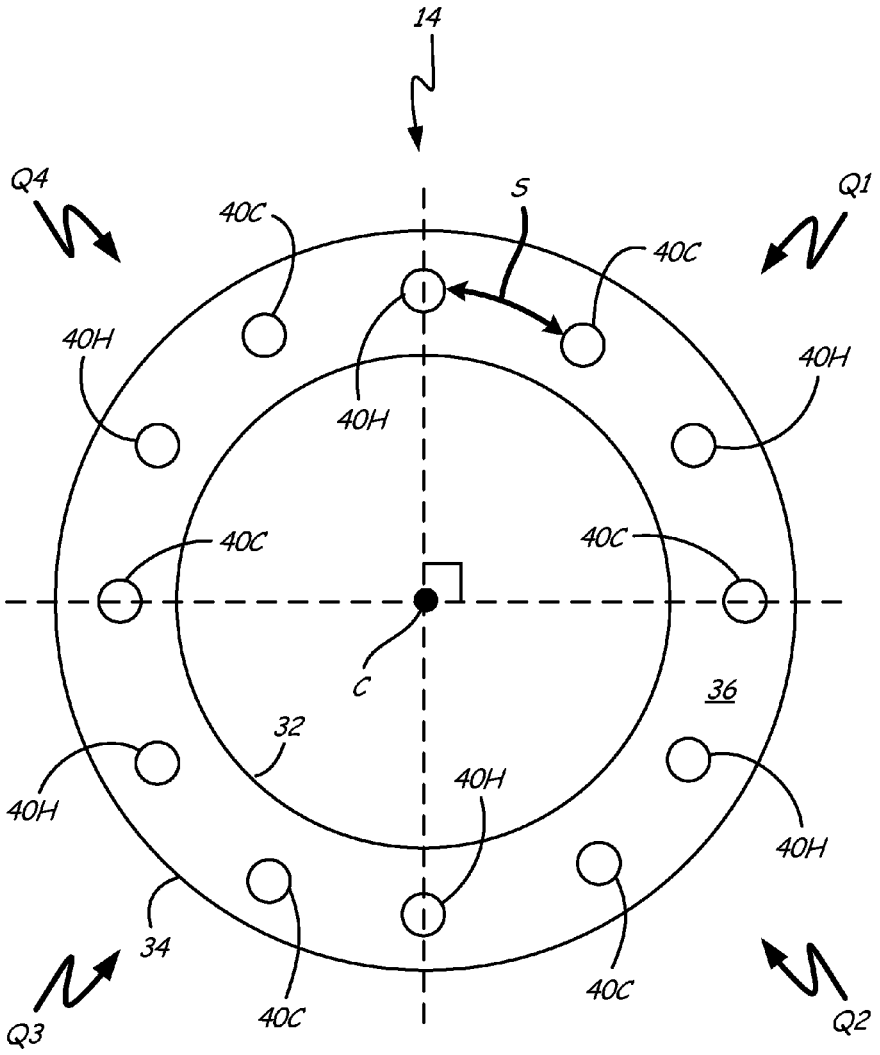
FIG. 3 Prior Art
FIG. 3 is a simplified line drawing of a prior art combustor taken substantially in the direction of line 3-3 in FIG. 1.

FIG. 3 shows prior art combustor 14, which includes hot fuel nozzles 40H and cold fuel nozzles 40C. Hot fuel nozzles 40H and cold fuel nozzles 40C are disposed in a circumferential array at uniformly spaced intervals, S, around bulkhead 36. Additionally, hot fuel nozzles 40H and cold fuel nozzles 40C are disposed such that hot fuel nozzles 40H and cold fuel nozzles 40C are arranged in an alternating pattern of H, C, H, C, etc. Uniform spacing of fuel nozzles can have destructive effects on the engine. For example, if there were four nozzles uniformly spaced 90 degrees apart then as the engine rotates it would see four disturbances. As the engine is rotating at a constant speed then the disturbances occur as beats uniformly spaced in time causing a constant frequency. If this frequency is close to a resonance frequency of the rotating elements of the engine then those elements can be excited by this frequency. This excitation can be destructive to the rotating elements. This theory is well understood in turbo-machinery and is typically employed in selecting the number of stationary elements, such as stators and vanes. The number of stationary elements is typically chosen to be a prime number in order to reduce the number of excitation frequencies. However, it is possible to space nozzles non-uniformly with a non-prime numbered array of nozzles. This non-uniform spacing results in smaller disturbance frequencies that is experienced by the engine components.

In contrast to the prior art, the present invention is an arrangement of fuel nozzles in a non-alternating pattern in order to avoid possible aerodynamic excitations downstream and to average out the cool and hot streaks for providing more uniform downstream temperatures. The non-alternating pattern of nozzles allows for more non-uniform spacing between nozzles to be employed. This non-uniform spacing follows a general rule that the space between any two cold nozzles ($S_{CC}$) is less than the space between a cold and hot nozzle ($S_{CH}$) which in turn would be less than the space between any two hot nozzles ($S_{HH}$). Placing two nozzles of the same type, hot or cold, adjacent to each other, rather than alternating hot and cold nozzles allows for non-uniform spacing while still maintaining uniform temperatures. Non-uniform spacing of the nozzles creates non-uniform spacing of aerodynamic disturbances and can result in uniform thermal profiles given nozzles with different levels of temperature increases are employed. Therefore, no strong disturbance frequencies are generated on the rotating elements and the uniform thermal profiles provide for better life of the stationary turbine nozzle. Additionally, the more uniform turbine inlet temperature results in increased life of turbine sections parts.

Figure 4:
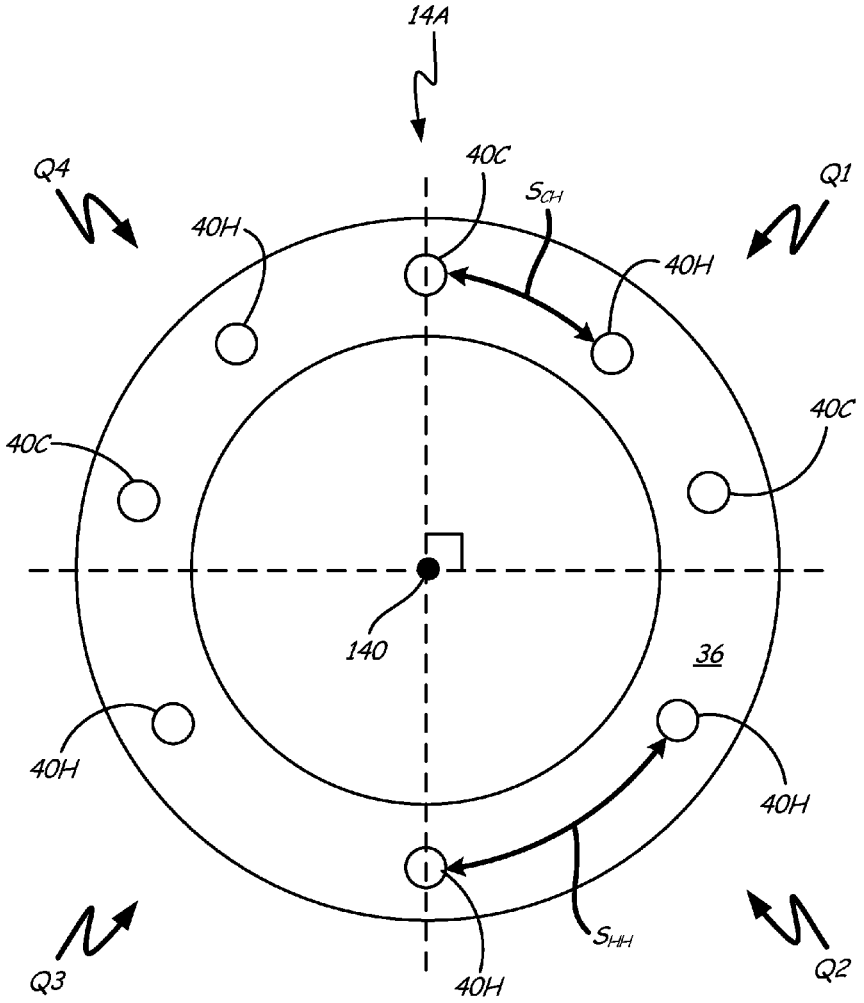
FIG. 4 is a simplified line drawing of an elevation view of a combustor according to a first embodiment taken substantially in the direction of line 3-3 in FIG. 1.

FIG. 4 shows combustor 14A according to a first embodiment, which includes a plurality of hot fuel nozzles 40H and cold fuel nozzles 40C disposed in a circumferential array around bulkhead 36. First quadrant Q1 has hot fuel nozzles 40H alternating with cold fuel nozzles 40C. Second quadrant Q2 has two hot fuel nozzles 40H adjacent to each other. According to the present embodiment, first quadrant Q1 contains equally spaced fuel nozzles of spacing $S_{CH}$ while second quadrant contains hot fuel nozzles which are spaced by $S_{HH}$. In an embodiment spacing $S_{HH}$ is different from spacing $S_{CH}$.

Figure 5:
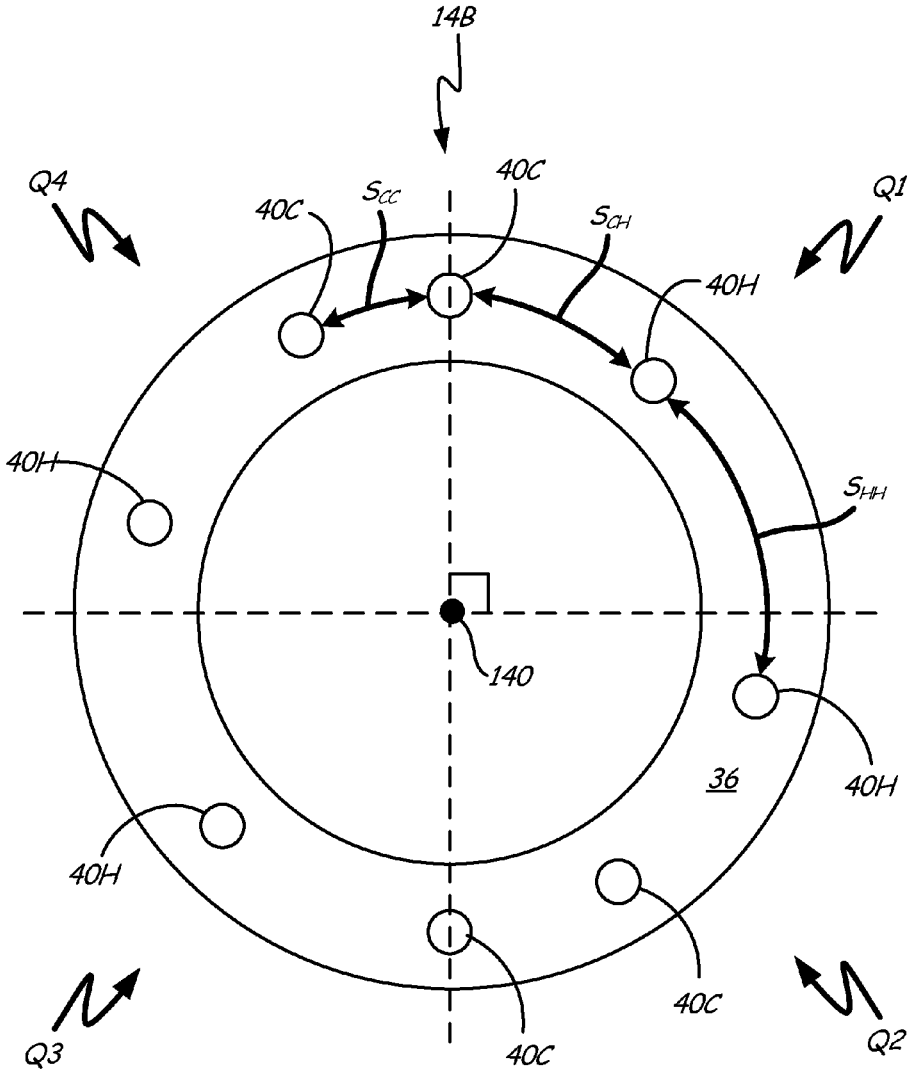
FIG. 5 is a simplified line drawing of an elevation view of a combustor according to a second embodiment taken substantially in the direction of line 3-3 in FIG. 1.

FIG. 5 shows combustor 14B according to a second embodiment, which includes a plurality of hot fuel nozzles 40H and cold fuel nozzles 40C disposed in a circumferential array around bulkhead 36. The array of fuel nozzles 40H & 40C is arranged such that there is at least one hot fuel nozzle 40H located immediately adjacent to another hot fuel nozzle 40H (in this example, the hot fuel nozzles 40H are located in both the first quadrant Q1 and third quadrant Q3 and located immediately adjacent to another hot fuel nozzle 40H). There is also at least one cold fuel nozzle 40C located immediately adjacent to another cold fuel nozzle 40C (in this example, the two adjacent cold fuel nozzles 40C are located in both the second quadrant Q2 and fourth quadrant Q4 and located immediately adjacent to another cold fuel nozzle 40C). According to the second embodiment of the present invention, a non-alternating pattern of hot and cold fuel nozzles 40H and 40C are arranged on bulkhead 36 with non-uniform spacing that allows for a more uniform temperature distribution than from a fuel nozzle arrangement which contains an alternating fuel nozzle pattern.

Figure 6:
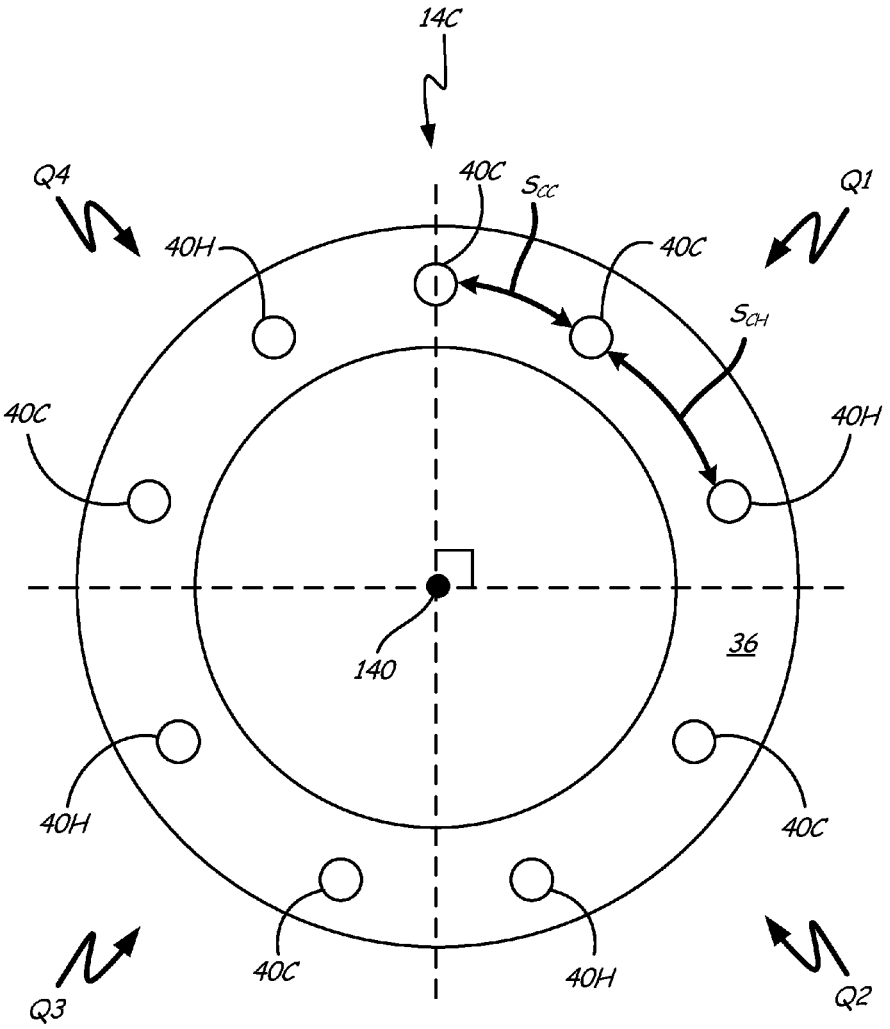
FIG. 6 is a simplified line drawing of an elevation view of a combustor according to a third embodiment taken substantially in the direction of line 3-3 in FIG. 1.

FIG. 6 shows combustor 14C according to a third embodiment, which includes a plurality of hot fuel nozzles 40H and cold fuel nozzles 40C disposed in a circumferential array around bulkhead 36. The array of fuel nozzles is arranged such that there is at least one cold fuel nozzle 40C located immediately adjacent to another cold fuel nozzle 40C (in this example, the two adjacent cold fuel nozzles 40C are located in first quadrant Q1). According to the third embodiment of the present invention, a non-alternating pattern of hot and cold fuel nozzles 40H and 40C are arranged on bulkhead 36 allowing for a non-uniform spacing that results in a more uniform temperature distribution than from a fuel nozzle arrangement which contains an alternating fuel nozzle pattern.

Figure 7:
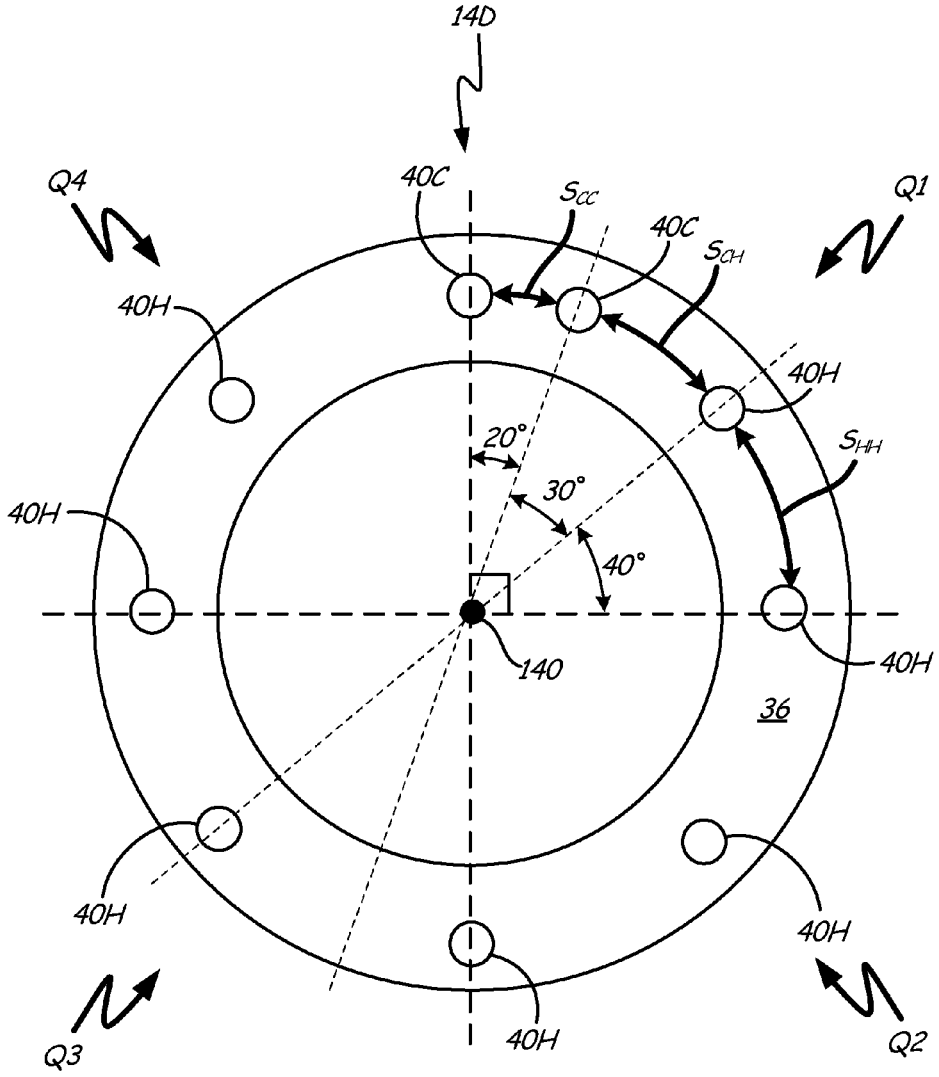
FIG. 7 is a simplified line drawing of an elevation view of a combustor according to a fourth embodiment taken substantially in the direction of line 3-3 in FIG. 1.

FIG. 7 shows combustor 14D according to a fourth embodiment, which includes a plurality of hot fuel nozzles 40H and cold fuel nozzles 40C disposed in a circumferential array around bulkhead 36. The array of fuel nozzles is arranged such that hot and cold fuel nozzles 40H and 40C are non-uniformly spaced. For example, first quadrant Q1 contains two cold fuel nozzles 40C adjacent to each other. Extending radial lines to the two cold fuel nozzles 40C located in the first quadrant Q1 creates a segment $S_{CC}$ in the first quadrant Q1 which is 20° of the 360° annular combustor 14D. Extending radial lines to the first cold nozzle 40C located in the first quadrant Q1 to the first hot nozzle 40H located in the first quadrant Q1 creates a segment $S_{CH}$ which is 30° of the 360° annular combustor 14D. Extending radial lines to the two hot fuel nozzles 40H located in first quadrant Q1 creates a segment $S_{HH}$ which is 40° of the 360° annular combustor 14D. Second quadrant Q2, third quadrant Q3, and fourth quadrant Q4 contain hot fuel nozzles 40H that are separated from an adjacent fuel nozzle by 40°. The difference in degrees of separation between fuel nozzles located in first quadrant Q1 and the other quadrants, and the circumferential placement of hot and cold fuel nozzles 40H and 40C around the annular bulkhead, creates a non-uniformly spaced pattern of hot and cold fuel nozzles 40H and 40C. According to the fourth embodiment of the present invention, a non-uniformly spaced pattern of hot and cold fuel nozzles 40H and 40C is arranged on bulkhead 36 allowing for a more uniform temperature distribution than from a fuel nozzle arrangement which contains a uniformly spaced fuel nozzle pattern.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A fuel nozzle arrangement comprising:

an annular combustor having four quadrants;

a plurality of fuel injectors disposed in the four quadrants; and a plurality of fuel nozzles of a first type and second type disposed onto the plurality of fuel injectors so that each fuel injector of the plurality of fuel injectors has either one first type fuel nozzle or one second type fuel nozzle attached to it, wherein the first type fuel nozzles are configured to provide a higher fuel flow than the second type fuel nozzles;

wherein the plurality of fuel injectors with attached first type and second type fuel nozzles are disposed with varying circumferential spacing which defines a circumferential array of the first type fuel nozzles and second type fuel nozzles in which at least two fuel nozzles of the same type are adjacent to each other, wherein the plurality of fuel nozzles of the circumferential array are spaced non-uniformly so that circumferential spacing between any two adjacent second type fuel nozzles is less than circumferential spacing between a second type fuel nozzle and an adjacent first type fuel nozzle, and the circumferential spacing between the second type fuel nozzle and the adjacent first type fuel nozzle is less than circumferential spacing between any two adjacent first type fuel nozzles, wherein adjacent fuel nozzles do not have any other fuel nozzle between them.

2. The arrangement of claim 1, wherein the four quadrants divide the annular combustor into four 90° segments.

3. A fuel nozzle arrangement comprising:

an annular combustor;

a plurality of fuel injectors circumferentially disposed in the combustor; and a plurality of first type fuel nozzles configured to provide a first fuel flow and a plurality of second type fuel nozzles configured to provide a second, lower fuel flow, the plurality of first type fuel nozzles and the plurality of second type fuel nozzles disposed onto the plurality of fuel injectors so that each fuel injector of the plurality of fuel injectors has either one first type fuel nozzle or one second type fuel nozzle attached to it;

wherein the plurality of fuel injectors with attached first type and second type fuel nozzles are disposed with varying circumferential spacing which defines a circumferential array of the first and second type fuel nozzles wherein the plurality of fuel nozzles are arranged in a non-alternating pattern of first type fuel nozzles and second type fuel nozzles, so that at least one of one type of fuel nozzle is located adjacent to an identical type of fuel nozzle, and so that circumferential spacing between any two adjacent second type fuel nozzles is less than circumferential spacing between a second type fuel nozzle and an adjacent first type fuel nozzle, and the circumferential spacing between the second type fuel nozzle and the adjacent first type fuel nozzle is less than circumferential spacing between any two adjacent first type fuel nozzles, wherein adjacent fuel nozzles do not have any other fuel nozzle between them.

4. The arrangement of claim 3, wherein:

the annular combustor has four quadrants; and at least two quadrants contain an unequal number of first type fuel nozzles and second type fuel nozzles.

5. A fuel nozzle arrangement comprising:

an annular combustor;

a plurality of fuel injectors disposed in the combustor; and a plurality of fuel nozzles of a first type and second type disposed onto the plurality of fuel injectors so that each fuel injector of the plurality of fuel injectors has either one first type fuel nozzle or one second type fuel nozzle attached to it;

wherein the plurality of fuel injectors with attached first type and second type fuel nozzles are disposed with varying circumferential spacing that defines an array of the first type fuel nozzles and second type fuel nozzles, wherein the first type fuel nozzles and second type fuel nozzles are arranged in a non-uniformly spaced circumferential array with at least one pair of first type fuel nozzles or least one pair of second type fuel nozzles being adjacent one another, so that circumferential spacing between any two adjacent second type fuel nozzles is less than circumferential spacing between a second type fuel nozzle and an adjacent first type fuel nozzle, and the circumferential spacing between the second type fuel nozzle and the adjacent first type fuel nozzle is less than circumferential spacing between any two adjacent first type fuel nozzles, wherein adjacent fuel nozzles do not have any other fuel nozzle between them.

6. The arrangement of claim 5, wherein the annular combustor has four quadrants; and wherein at least two quadrants contain an unequal number of first type fuel nozzles and second type fuel nozzles.

7. The arrangement of claim 6, wherein at least one quadrant is bounded by a first type fuel nozzle and contains at least one first type fuel nozzle and one second type fuel nozzle.

* * * * *